US011095061B2

(12) United States Patent
Biller et al.

(10) Patent No.: US 11,095,061 B2
(45) Date of Patent: Aug. 17, 2021

(54) ELECTRICAL PLUG CONNECTOR

(71) Applicant: MICRO-EPSILON Messtechnik GmbH & Co. KG, Ortenburg (DE)

(72) Inventors: Benedikt Biller, Deggendorf (DE); Norbert Reindl, Fürstenzell (DE)

(73) Assignee: MICRO-EPSILON MESSTECHNIK GMBH & CO. KG, Ortenburg (DE)

( * ) Notice: Subject to any disclaimer, the term of this patent is extended or adjusted under 35 U.S.C. 154(b) by 0 days.

(21) Appl. No.: 16/221,146

(22) Filed: Dec. 14, 2018

(65) Prior Publication Data

US 2019/0190181 A1 Jun. 20, 2019

(30) Foreign Application Priority Data

Dec. 14, 2017 (DE) ..... 102017222809.1

(51) Int. Cl.
*H01R 13/187* (2006.01)
*H01R 24/56* (2011.01)
(Continued)

(52) U.S. Cl.
CPC ..... *H01R 13/187* (2013.01); *H01R 9/05* (2013.01); *H01R 9/0527* (2013.01);
(Continued)

(58) Field of Classification Search
CPC ..... H01R 2103/00; H01R 2105/00; H01R 24/58; H01R 24/40; H01R 24/44; H01R 24/50; H01R 24/56; H01R 24/562
See application file for complete search history.

(56) References Cited

U.S. PATENT DOCUMENTS 3,179,912 A * 4/1965 Huber ..... H01R 13/56 439/581
3,915,535 A 10/1975 O'Keefe et al.
(Continued)

FOREIGN PATENT DOCUMENTS

DE 1268704 B 5/1968
DE 69622241 T2 3/2003
(Continued)

*Primary Examiner* — Edwin A. Leon
*Assistant Examiner* — Matthew T Dzierzynski
(74) *Attorney, Agent, or Firm* — Jason P. Mueller; FisherBroyles, LLP

(57) ABSTRACT

An electrical plug connector for a coaxial or triaxial cable, wherein the cable includes an internal conductor, a first shielding conductor surrounding the internal conductor and extending coaxially with it, and optionally a second shielding conductor surrounding the first shielding conductor. The plug connector has a connector body, which includes an internal conductor contact element designed as a plug, socket, or coupling, for contacting with the internal conductor, an internal shield contact element provided for contacting with the first shielding conductor, and optionally an external shield contact element provided for contacting with the second shielding conductor. The connector body is configured such that the contact elements in the mounted condition of the plug connector are arranged on the cable such that a maximum diameter of the connector body is less than or equal to the outer diameter of the cable or only slightly larger than the outer diameter of the cable.

10 Claims, 3 Drawing Sheets

Figure 1:
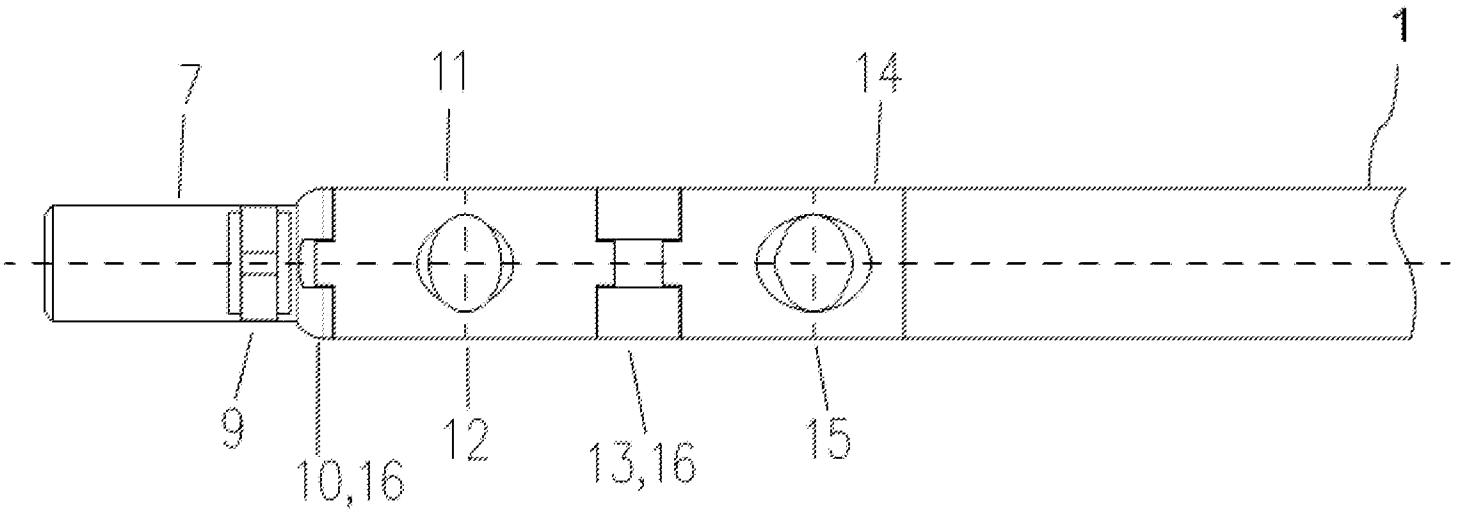

(51) Int. Cl.

| | |
|---|---|
| ***H01R 13/6583*** | (2011.01) |
| ***H01R 9/05*** | (2006.01) |
| ***H01R 24/58*** | (2011.01) |
| ***H01R 24/50*** | (2011.01) |
| ***H01R 105/00*** | (2006.01) |
| ***H01R 103/00*** | (2006.01) |

(52) U.S. Cl.
CPC ..... *H01R 13/6583* (2013.01); *H01R 24/56* (2013.01); *H01R 24/58* (2013.01); *H01R 24/50* (2013.01); *H01R 2103/00* (2013.01); *H01R 2105/00* (2013.01)

(56) References Cited

U.S. PATENT DOCUMENTS 5,730,623 A * 3/1998 Krantz ..... H01R 24/44 439/580
5,967,852 A * 10/1999 Follingstad ..... H01R 9/0521 439/675
6,575,786 B1 * 6/2003 Khemakhem ..... H01R 13/5804 439/578
6,809,265 B1 * 10/2004 Gladd ..... H02G 15/085 174/74 R
7,090,516 B2 * 8/2006 Khemakhem ..... H01R 4/70 439/135
7,802,993 B2 9/2010 Akama et al.
8,007,319 B2 * 8/2011 Dang ..... H01R 4/18 439/607.56
8,419,469 B2 * 4/2013 Montena ..... H01R 9/0524 439/578
2012/0138361 A1 6/2012 Elliott

FOREIGN PATENT DOCUMENTS

DE 10323616 A1 8/2004
DE 20 2015 106 343 U1 2/2017
EP 1246316 B1 3/2004

* cited by examiner

A-A

ELECTRICAL PLUG CONNECTOR

This application claims priority to German Patent Application No. 10 2017 222 809.1, filed Dec. 14, 2017, the entire contents of which is incorporated herein by reference The disclosure relates to an electrical plug connector for a coaxial or triaxial cable, wherein the cable comprises an internal conductor, a first shielding conductor surrounding the internal conductor and extending coaxially with it, and optionally in addition a second shielding conductor surrounding the first shielding conductor.

Conventional connectors on the market, especially coaxial or triaxial plug connectors, are available in the most diverse configurations. Usually, plug and socket are firmly connected to a coaxial or triaxial conductor line, whether by soldering or crimping. Coaxial or triaxial plug connectors are usually shielded, that is, the central conductor is shielded by at least one surrounding conductor. In order to accomplish a continuous shielding action, plug and socket are constructed in relatively complicated fashion of alternating contact surfaces and insulating sheaths. This means that the plug and socket have a large outer diameter as compared to the conduction line itself. For example, EP 1 246 316 B1 shows a plug connector according to the prior art.

What is common to the plugs and sockets which can be mounted on conduction lines is that a completely mounted plug or socket on a conduction line has a distinctly larger diameter than the line itself. This larger diameter of a plug connector has the disadvantage, in particular, that when the cable is laid afterwards a lead-through (or conduits or boreholes) must always have at least the cross section of the plug or socket, even if the conduction line itself is much smaller. Especially when laying conduction lines in the field, the lead-through must then be bored out which is costly. Alternatively, the plug connector could be dismounted and then be put back on after threading the line through the narrow spot. This comes with the danger of losing parts of the plug. Often special tools are also needed, which may not be on hand or are hard to get.

Therefore, the problem which the present disclosure proposes to solve is to configure and modify an electrical plug connector of the above mentioned kind such that a simple and flexible handling of the plug connector is made possible, especially as regards laying the cable through narrow conduits or boreholes.

The above problem is solved in accordance with the disclosure. Accordingly, the electrical plug connector in question is characterized by a connector body, which comprises an internal conductor contact element designed as a plug, socket, or coupling, for contacting with the internal conductor, an internal shield contact element provided for contacting with the first shielding conductor, and optionally in addition an external shield contact element provided for contacting with the second shielding conductor, wherein the contact elements in the mounted condition of the plug connector are arranged on the cable such that a maximum diameter of the connector body is less than or equal to the outer diameter of the cable or only slightly larger than the outer diameter of the cable.

A particularly slender design of the plug connector can be achieved by providing respective separate contact elements for the contacting of the internal conductor of the cable and for the contacting of the shield or shields of the internal conductor, and that it is possible to arrange these independent contact elements together forming the connector body on the cable such that in the mounted condition of the plug connector they do not reach the maximum diameter of the cable or are only slightly larger than it. Accordingly, the present disclosure provides an electrical plug connector which is smaller in diameter or equal to the outer diameter of the cable or only slightly larger than this and therefore affords distinct benefits for a laying of the cable. In particular, when laying the cable through a narrow lead-through, there is no need to either enlarge the lead-through or, if that is not possible, to first dismount the plug connector from the cable and then put it back on after threading the cable through the lead-through. Furthermore, according to embodiments of the plug connector, the important shielding properties especially for coaxial and triaxial plugs are not affected. Moreover, the plug connector despite its complex design remains detachable and can be repeatedly plugged in. No special tool is needed for the plugging. If a plug connector designed as a plug according to the disclosure is mounted on the corresponding socket, a shield-tight connection will be produced, depending on the embodiment, being comparable to customary round plugs (such as BNC).

It should be pointed out in this place that the technical term "conductor line" and the more common term "cable" are used synonymously in the present disclosure.

According to one preferred embodiment, the contact elements in the mounted condition of the plug connector are arranged on the cable such that the maximum diameter of the connector body is only at most 2 mm, preferably at most 1 mm or especially preferably less than 0.5 mm larger than the outer diameter of the cable. Ideally, the maximum diameter of the connector body is less than or equal to the outer diameter of the cable.

Regardless of the absolute dimensioning of the cable, in one preferred embodiment the contact elements in the mounted condition of the plug connector are arranged on the cable such that the maximum diameter of the connector body is at most 10%, preferably at most 5% larger than the outer diameter of the cable. Ideally, the maximum diameter of the connector body is less than or equal to the outer diameter of the cable.

According to one advantageous embodiment of the disclosure, the contact elements in the mounted condition of the plug connector are arranged offset from each other in the axial direction or arranged substantially one behind the other, so that despite the complex construction the maximum outer diameter of the connector body can be less than or equal to the outer diameter of the cable or only slightly larger than the outer diameter of the cable.

For the electrical insulation between the internal conductor contact element and the internal shield contact element, the connector body may furthermore comprise a preferably ring-shaped insulating element suitable for pushing onto the internal shield/internal conductor insulation of the cable. Finally, the connector body may comprise another insulating element suitable for pushing onto the external shield/internal shield insulation of the cable for the electrical insulation between the internal shield contact element and the external conductor contact element.

In the context of the construction of the plug connector, the contact elements and the insulating elements are shoved onto the corresponding stripped sections of the line and then plugged together or press fitted together. According to one advantageous embodiment, the contact elements and the insulating elements are designed for the mutual engaging such that in the mounted condition a shield-tight design of the plug connector is realized. According to another advantageous embodiment, the contact elements and the insulating elements comprise mutually engaging tongue and groove elements to realize a rotation locking of the plug connector in the axial direction.

In regard to an especially secure handling of the plug connector, an interlock mechanism can be provided for the plug connector, this mechanism being preferably realized by means of the insulating element acting between the internal shield contact element and the external shield contact element. For this purpose, this insulating element may have projections for example, formed along the circumferential surface. These projections may be designed so as to produce a detent action, for example when they form an abutment with the cable-side end face of the external shield contact element in the mounted condition of the plug connector. Depending on the design of the interlock, this may be released once again without a tool, so that the plug connector is designed as a pull-out connector. Alternatively, the interlock mechanism may be designed so that the plug connection can only be released by means of an unlocking tool.

In regard to an effective handling, it may be provided that the contact elements and the insulating elements are configured as a premounted unit suitable for pushing onto one end of the cable appropriately stripped of insulation for a portion. Accordingly, the plug connector parts in their entirety can be pushed in a single work step entirely onto the stripped cable and then be soldered. Alternatively, however, it is also possible to connect the individual plug connector parts (i.e., the contact elements as well as the respective insulating elements arranged between then) one by one to the cable and thereby assemble the plug connector step by step on the cable.

According to one preferred embodiment, the plug connector is designed to be connected on a circuit board. For this, the described plug connector may comprise a mating piece which is contactable with the circuit board, wherein the mating piece specifically comprises an external shield housing as well as an internal shield housing, the two preferably having a rectangular cross section of the same size. A spring contact element designed for contacting the external shield contact element of the contactor body is arranged in the external shield housing and a spring contact element designed for contacting the internal shield contact element is arranged in the internal shield housing. In the event that the internal conductor contact element is designed as a socket on the connector body, a corresponding internal conductor contact pin can be advantageously integrated on the board-side mating piece for engaging in this socket-shaped internal conductor contact element on the connector body in the internal shield housing. In this case, the internal conductor contact pin would have to be electrically insulated against the internal shield housing or the spring contact element for the internal shield contact element by means of a suitable insulating body.

According to the above embodiment, the plug connector has no spring contact elements on the outside. Instead, all spring contact elements are basically placed inside the housing, i.e., in the more protected internal region of the plug connector, so that they are effectively protected against damage. On the whole, therefore, an especially danger-free threading of the plug connector through conduits or lead-throughs is possible. In particular, such a plug connector is also easily mounted by the end user on a circuit board without any special tools. Thanks to the slender design of the connection body on the cable, the mating piece at the circuit board side is also not much bigger than the connector body on the cable, i.e., the outer dimensions of the internal shield and external shield housing are only slightly larger than the outer dimensions of the plug portion or the connector body on the cable.

There are various ways of embodying and modifying the teaching of the present disclosure. In connection with the explanation of preferred exemplary embodiments of the disclosure with the aid of the drawing, preferred embodiments and modifications of the teaching are described below. The drawings show FIG. 1 a plug connector according to a first exemplary embodiment in accordance with the disclosure, FIG. 2 a plug connector according to a second exemplary embodiment in accordance with the disclosure, FIG. 3 the plug connector of FIG. 2 in a cross sectional representation, FIG. 4 a plug connector for contacting on a circuit board according to another exemplary embodiment in accordance with the disclosure, and FIG. 5 the plug connector of FIG. 4 in the mounted condition on a triaxial conduction line.

FIG. 1 shows in a schematic view a plug connector according to a first exemplary embodiment in accordance with the disclosure. The plug connector is designed as a triaxial plug connector, i.e., as a plug connector for connection to a triaxial cable 1 with an internal conductor 6, a first shielding conductor 4 (hereafter called internal shield) concentrically surrounding the internal conductor 6 and a second shielding conductor 2 (hereafter called external shield) concentrically surrounding the internal shield 4, as shown by the cross sectional view of FIG. 3. The plug connector accordingly comprises an internal conductor contact element 7 designed for contacting with the internal conductor 6, an internal shield contact element 11 designed for contacting with the internal shield 4, and an external shield contact element 14 designed for contacting with the external shield 2. The individual elements are mutually plugged into or press fitted to each other, and each time an insulating element 10, 13 is provided between the individual contact elements, as further described below in detail.

The contacting may be realized by means of soldering through corresponding soldering bores 9, 12, and 15 formed on the respective contact elements 7, 11 and 14. Alternatively to soldered connections, the connections between the cable 1 and the respective contact elements 7, 11 and 14 may also be produced by gluing, crimping or welding. In these cases, the soldering bores 9, 12, and 15 can be omitted.

For the mounting of the plug connector on the triaxial cable 1, the cable is stripped of its insulation in stages. On the stripped end, the individual plug connector parts comprising the above mentioned contact elements 7, 11 and 14 are shoved according to the solution shown as an example in FIG. 3.

Specifically, the external shield contact element 14 designed preferably as a round contact tube is shoved onto the external shield 2 of the cable 1 and soldered to the external shield 2, e.g., via the soldering bore 15, or alternatively glued or also crimped or welded. The nature of the electrical connection is not limited to the above.

An insulating element 13 serves as insulation between external shield 2 and internal shield 4, or between the external shield contact element 14 and the internal shield contact element 11. The insulating element 13, which is made of nonconducting material, is shoved onto the external shield/internal shield insulation 3 of the cable 1. According to the embodiment represented in FIG. 3, the insulating element 13 is ring or tube shaped with a constant internal diameter over the entire length, adapted to the outer diameter of the external shield/internal shield insulation 3 of the cable 1. Furthermore, the insulating element 13 has a front region and a rear region, each with an outer diameter reduced as compared to a middle region. When the plug connector is assembled, the rear region, i.e., the one at the cable side, with reduced outer diameter, engages in a front region of the external shield contact element 14 with correspondingly enlarged internal diameter.

On the internal shield 4, similar to the external shield 2, the internal shield contact element 11 is shoved, likewise being designed preferably as a round contact tube. In this process, the front region of the insulating element 13, i.e., the one at the cable side, with reduced outer diameter, engages with a rear region of the internal shield contact element 11 with correspondingly increased internal diameter. According to the embodiments represented, the internal shield contact element 11 is soldered via the soldering bore 12 to the internal shield 4.

Furthermore, the internal conductor contact element 7 is shoved onto the internal conductor 6. According to the embodiments shown, the internal conductor contact element 7 is soldered via the soldering bore 9 to the internal conductor 6. The insulation between the internal shield 4 and the internal conductor 6, or that between the internal shield contact element 11 and the internal conductor contact element 7, is produced by means of a further insulating element 10. The insulating element 10 in the embodiment shown in FIG. 3 has a rear region, i.e., at the cable side, with an inner diameter adapted to the outer diameter of the internal shield/internal conductor insulation 5 of the cable 1. In the rear region, the insulating element 10 furthermore has a reduced outer diameter, so that this region in the mounted condition of the plug connector comes to engage with a front region of the internal shield contact element 11 with increased inner diameter. Finally, the insulating element 10 has a front region with enlarged inner diameter, with which a rear region of the internal conductor contact element 7 with reduced outer diameter comes to engage in the mounted condition of the plug connector.

As already mentioned, the internal conductor contact element 7, the insulating element 10 (internal conductor/internal shield), the internal shield contact element 11, the insulating element 13 (external shield/internal shield) and the external shield contact element 14 are plugged or press fitted together.

The outer diameters of the insulating elements 10, 13 and the contact elements 11, 14 are configured such that they are individually or also jointly less than or equal to the outer diameter of the cable or they are only slightly larger than it. According to one embodiment, the individual elements are configured such that an interlocking in the axial direction is produced by a combination of radial tongues and grooves. The elements therefore have a high mechanical strength in the plugging direction and are secured against unintentional loosening.

Figure 3:
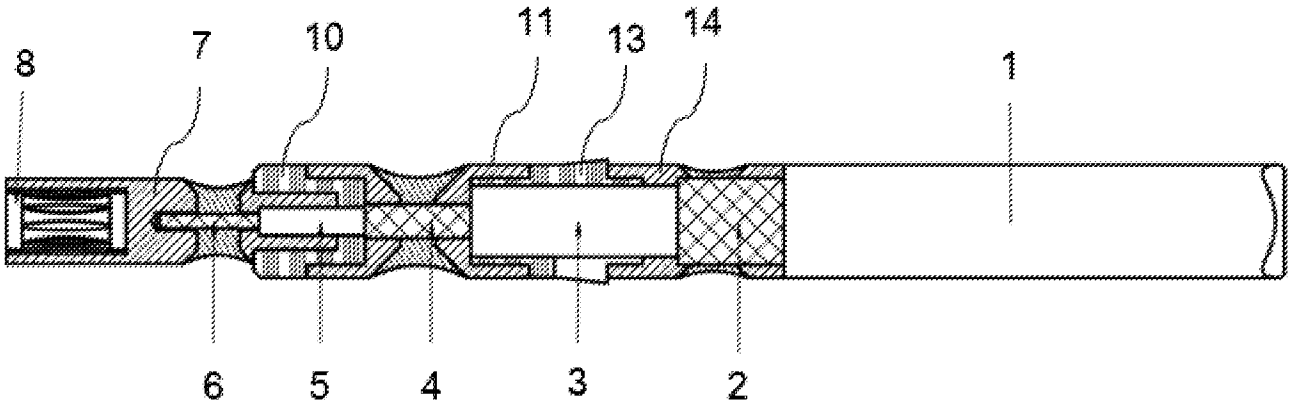

As can be seen from FIG. 3, the internal conductor contact element 7 is designed as a socket in the exemplary embodiment shown, while a rotationally symmetrical spring contact 8 is integrated in the internal conductor contact element 7. In a corresponding plug (not shown) configured as a mating piece, the internal conductor contact element 7 would have a contact pin in place of the spring contact 8, suitable to be received by the spring contact 8 in releasable nonpositive locking.

Figure 2:
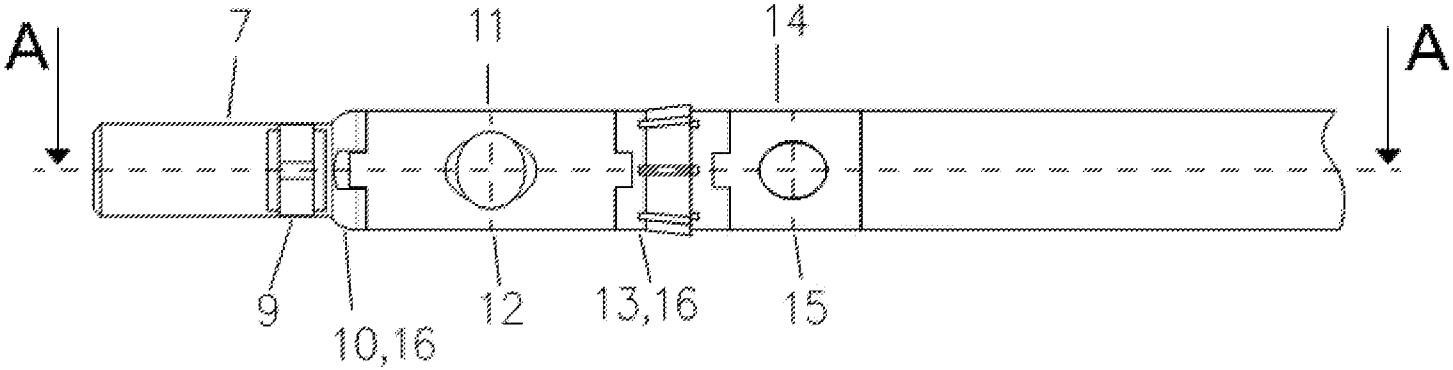

According to one embodiment, the two insulating elements 10, 13 as well as the contact elements 7, 11 and 14 comprise tongue and groove elements 16 in the axial direction, as shown for example in FIGS. 1 and 2. These grooves and tongues are configured such that a twisting of individual elements relative to each other is prevented, which might lead to a damaging of the cable 1. If the cable 1 experiences a torsion, for example, this can be propagated onto the respective contact elements 7, 11 and 14 and onto the rotationally symmetrical spring contact 8. In this way, the plug connector or the cable 1 is not damaged. In particular, the soldering locations at the soldering bores 9, 12 and 15 are not placed under torsion.

The insulating element 13, which in the mounted condition of the plug connector sits on the external shield/internal shield insulation 3 of the cable 1, as can be seen in the cross sectional view of FIG. 3, can be designed so that at the same time it serves as an interlock for the plug connector. Thus, the insulating element 13 has edge-shaped projections at the cable side, according to the embodiment represented in FIGS. 2 and 3, which in the mounted condition come to bear against a front end face of the external shield contact element 14. Depending on the configuration of these edges, the interlock may be designed so that the plug connector is automatically releasable or released with a given tensile force, or so that a releasing can only be achieved by means of an additional tool.

If there is no need for the interlock or if the plug connector is designed as a breaking connector, the insulating element 13 may also be designed entirely without an interlock function. Such a design is shown schematically in FIG. 1.

Figure 4:
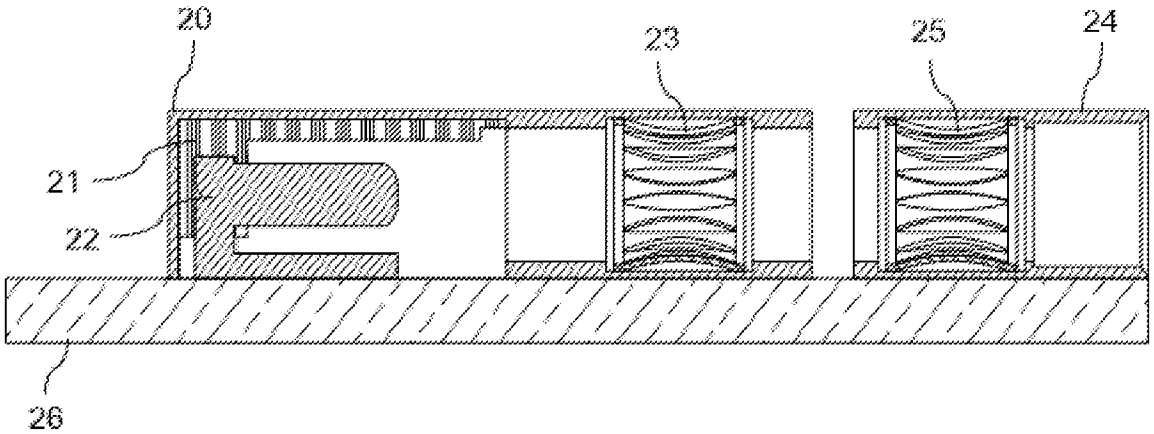
Figure 5:
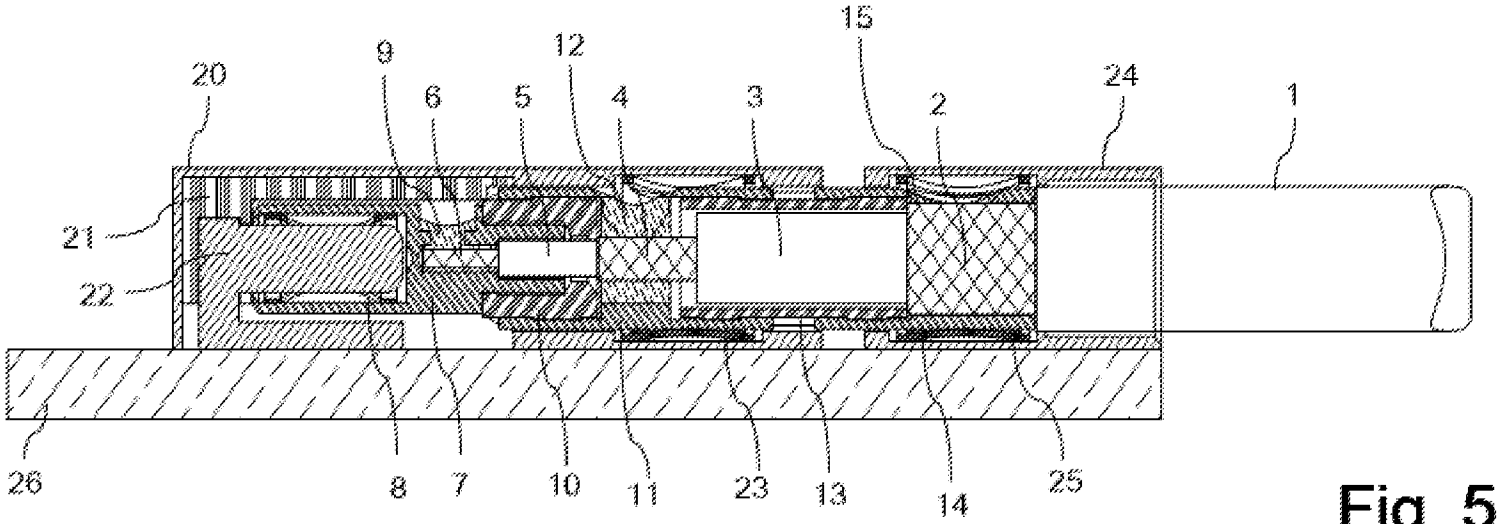

FIGS. 4 and 5 show a plug connector for contacting on a circuit board 26 according to a further exemplary embodiment of the disclosure. The plug connector comprises a mating piece arranged on the circuit board 26, the mating piece having an external shield housing 24 with a spring contact element 25 designed for contacting the external shield contact element 14 and an internal shield housing 20 with a spring contact element 23 designed for contacting the internal shield contact element 11. While FIG. 4 shows only the mating piece, FIG. 5 shows the mating piece with an inserted plug connector, as was described above in connection with FIG. 1-3.

In the example shown, the internal conductor contact element 7 secured to the conduction line 1 is designed as a socket, while the resilient contact element 8 for the internal conductor 6 is already integrated in the internal conductor contact element 7. The further spring contact elements 23 and 25 as described above sit in the internal shield housing 20 and external shield housing 24 of the mating piece. Accordingly, no sensitive electrical contacts lie on the outside on the plug connector, which means a very robust and durable cable laying.

The internal shield housing 20 in addition to the spring contact element 23 comprises an internal conductor contact pin 22, which is electrically insulated against the spring contact element 23 by means of an insulating body 21. The internal conductor contact pin 22 in the exemplary embodiment represented is designed as a massive pin, which in the connected condition produces the electrical contact with the spring contact 8 in the internal conductor contact element 7, as shown in FIG. 5. The two further spring contact elements, i.e., the spring contact 23 for the internal shield 4 and the spring contact 25 for the external shield 2, in turn constitute the electrical contact with the internal shield contact element 11 and the external shield contact element 14.

In the exemplary embodiment shown, the external shield housing 24 of the mating piece ends before the internal shield housing 20. Depending on the nature of the fastening of the internal shield housing 20 and the external shield housing 24 on the circuit board 26, it may be useful to provide a spacer and place holder to maintain a constant distance between the internal shield housing 20 and the external shield housing 24, acting between the mutually opposite end faces of the internal shield housing 20 and the external shield housing 24. The distance between the internal shield housing 20 and the external shield housing 24 may be utilized for the interlocking of the plug connection, such that the insulating element 13 at the cable side is provided with elastic or resilient lugs or projections, for example (as shown in FIG. 3). While these allow a pushing in or introducing of the plug connector through the external shield housing 24 into the internal shield housing 20 of the mating piece, they prevent the opposite movement, i.e., a loosening of the plug connection, once the projections have locked into the gap between internal shield housing 20 and external shield housing 24, since the cable-side end surfaces of the projections form an abutment with the end face of the external shield housing 24. Accordingly, a loosening of the plug connection is only possible by means of an additional tool.

It should be noted that the insulating element 13 is fashioned as a ring in the embodiment shown in FIG. 5 and has no projections. Accordingly, in this embodiment no interlocking is realized, but rather the plug connector can be automatically loosened with a given tensile force.

Alternatively to providing a distance between internal shield housing 20 and external shield housing 24 as described above, it is also possible to pull the external shield housing 24 forward across the internal shield housing 20, i.e., in the direction of the internal conductor 6, but then this would mean a step formation of the diameters or a larger diameter for the external shield housing 24.

As regards the handling of the plug connection according to FIG. 5 it should be mentioned in conclusion that on the one hand it is possible to shove or introduce the cable 1 with the connector body mounted on the cable 1 (comprising the contact elements 7, 11 and 14 as well as the insulating elements 10 and 13) into the housing 20, 24 already premounted on the support board 26. On the other hand, it is likewise possible to first shove or introduce the cable with mounted connector body into the housing 20, 24 and only then contact the entire plug connection as a unit with the corresponding contacts on the support board 26.

In order to avoid repetition, refer to the general portion of the specification and to the enclosed claims with regard to further advantageous embodiments of the device according to the disclosure.

Finally, it should be expressly pointed out that the above described exemplary embodiments of the device according to the disclosure serve solely to explain the claimed teaching, but do not limit it to the exemplary embodiments.

LIST OF REFERENCE NUMBERS

1 Triaxial line/cable
2 External shield
3 External shield/internal shield insulation
4 Internal shield
5 Internal shield/internal conductor insulation
6 Internal conductor
7 Internal conductor contact element
8 Spring contact of internal conductor
9 Soldering bore of internal conductor
10 Insulating element
11 Internal shield contact element
12 Soldering bore of internal shield
13 Insulating element
14 External shield contact element
15 Soldering bore of external shield
16 Tongue and groove rotation locking
20 Internal shield housing
21 Insulating body
22 Internal conductor contact pin
23 Spring contact of internal shield
24 External shield housing
25 Spring contact of external shield
26 Circuit board/support board

The invention claimed is:

1. An electrical plug connector for a coaxial cable, the coaxial cable including an internal conductor and a first shielding conductor surrounding the internal conductor and extending coaxially with the internal conductor, the electrical plug connector comprising:

a connector body, which includes an internal conductor contact element configured to contact the internal conductor and an internal shield contact element configured to contact the first shielding conductor, wherein the internal conductor contact element is configured as a socket with a spring contact integrated therein, wherein the internal conductor contact element and the internal shield contact element, in a mounted configuration of the plug connector, are arranged separate from each other in an axial direction so that the internal conductor contact element and the internal shield contact element are partially overlapping, the internal conductor contact element having a region of overlap in a radial direction with the internal shield contact element and having a region of no overlap in the radial direction with the internal shield contact element, on the cable such that a maximum diameter of the connector body is less than or equal to an outer diameter of the cable or only slightly larger than the outer diameter of the cable, and wherein the cable includes a second shielding conductor and wherein the connector body includes an external shield contact element, the plug connector further comprising a mating piece which is contactable on a circuit board, wherein the mating piece includes an external shield housing with a spring contact element configured for contacting the external shield contact element as well as an internal shield housing with a spring contact element configured for contacting the internal shield contact element.

2. The plug connector as claimed in claim 1, wherein the internal shield housing includes an internal conductor contact pin electrically insulated against the spring contact element for contacting the internal conductor contact element, and wherein the internal conductor contact element is socket-shaped.

3. An electrical plug connector for a triaxial cable, the triaxial cable including an internal conductor, a first shielding conductor surrounding the internal conductor and extending coaxially with the internal conductor, and a second shielding conductor surrounding the first shielding conductor, the electrical plug connector comprising:

a connector body, which includes an internal conductor contact element configured to contact the internal conductor, an internal shield contact element configured to contact the first shielding conductor, and an external shield contact element configured to contact the second shielding conductor, wherein the internal conductor contact element is configured as a socket with a spring contact integrated therein, and wherein the internal conductor contact element, the internal shield contact element, and the external shield contact element, in a mounted configuration of the plug connector, are arranged separate from each other in an axial direction so that the external shield contact element is non-overlapping in a radial direction with the internal conductor contact element and the internal shield contact element, while the internal conductor contact element and the internal shield contact element are partially overlapping, the internal conductor contact element having a region of overlap in a radial direction with the internal shield contact element and having a region of no overlap in a radial direction with the internal shield contact element, on the cable such that a maximum diameter of the connector body is less than or equal to an outer diameter of the cable or only slightly larger than the outer diameter of the cable.

4. The plug connector as claimed in claim 3, wherein the connector body includes a ring-shaped insulating element configured for pushing onto an internal shield/internal conductor insulation of the cable for an electrical insulation between the internal conductor contact element and the internal shield contact element.

5. The plug connector as claimed in claim 4, wherein the connector body includes an insulating element configured for pushing onto an external shield/internal shield insulation of the cable for an electrical insulation between the internal shield contact element and the external shield contact element.

6. The plug connector as claimed in claim 5, wherein the internal conductor contact element, the internal shield contact element, the external shield contact element, the ring-shaped insulating element, and the insulating element are configured for mutual engaging such that in the mounted condition a shield-tight design of the plug connector is realized.

7. The plug connector as claimed in claim 5, wherein the internal conductor contact element, the internal shield contact element, the external shield contact element, the ring-shaped insulating element, and the insulating element include mutually engaging tongue and groove elements to realize a rotation locking of the plug connector in an axial direction.

8. The plug connector as claimed in claim 5, wherein the insulating element include an interlock mechanism for the plug connector.

9. The plug connector as claimed in claim 5, wherein the internal conductor contact element, the internal shield contact element, the external shield contact element, the ring-shaped insulating element, and the insulating element are configured as a premounted unit configured for pushing onto one end of the cable that is stripped of insulation for a portion.

10. The plug connector as claimed in claim 3, further comprising a mating piece which is contactable on a circuit board, wherein the mating piece includes an external shield housing with a spring contact element configured for contacting the external shield contact element as well as an internal shield housing with a spring contact element configured for contacting the internal shield contact element.

* * * * *